US011639070B2

(12) United States Patent
Furuyama et al.

(10) Patent No.: US 11,639,070 B2
(45) Date of Patent: May 2, 2023

(54) PRINT MEDIUM FEEDING DEVICE

(71) Applicant: BROTHER KOGYO KABUSHIKI KAISHA, Nagoya (JP)

(72) Inventors: Toshiyuki Furuyama, Toyohashi (JP); Ryoya Takahashi, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 190 days.

(21) Appl. No.: 17/214,758

(22) Filed: Mar. 26, 2021

(65) Prior Publication Data

US 2021/0300067 A1 Sep. 30, 2021

(30) Foreign Application Priority Data

Mar. 31, 2020 (JP) ..... JP2020-062052

(51) Int. Cl.

| | |
|---|---|
| ***B41J 11/00*** | (2006.01) |
| ***B41J 11/50*** | (2006.01) |
| ***B41J 11/66*** | (2006.01) |
| ***B41J 13/00*** | (2006.01) |
| ***B41J 13/02*** | (2006.01) |
| ***B41J 15/02*** | (2006.01) |
| ***B41J 15/04*** | (2006.01) |
| ***B41J 15/20*** | (2006.01) |
| ***B41J 15/22*** | (2006.01) |
| ***B65H 5/06*** | (2006.01) |

(Continued)

(52) U.S. Cl.

CPC ..... *B41J 15/20* (2013.01); *B41J 11/007* (2013.01); *B41J 11/0045* (2013.01); *B41J 11/50* (2013.01); *B41J 11/66* (2013.01); *B41J 13/0018* (2013.01); *B41J 13/02* (2013.01); *B41J 15/02* (2013.01); *B41J 15/046* (2013.01); *B41J 15/22* (2013.01); *B65H 5/06* (2013.01); *B65H 16/106* (2013.01); *B65H 18/02* (2013.01)

(58) Field of Classification Search

CPC ..... B41J 11/0045; B41J 11/007; B41J 11/50; B41J 11/66; B41J 13/0018; B41J 13/02; B41J 15/02; B41J 15/046; B41J 15/20; B41J 15/22; B65H 5/06; B65H 18/02

See application file for complete search history.

(56) References Cited

U.S. PATENT DOCUMENTS

2008/0003043 A1* 1/2008 Fukui ..... B41J 15/044 400/615.2

FOREIGN PATENT DOCUMENTS

JP 2012-223923 A 11/2012
JP 2019198989 A * 11/2019

* cited by examiner

*Primary Examiner* — Christopher E Mahoney
*Assistant Examiner* — Kendrick X Liu
(74) *Attorney, Agent, or Firm* — Kenealy Vaidya LLP

(57) ABSTRACT

A print medium feeding device removes a second sheet from a print medium that is in a state in which a first sheet, the second sheet, a the third sheet are superposed, superposes the first sheet and the third sheet, and feeds the first sheet and the third sheet to a printing device. The print medium feeding device includes: a first roller configured to come into contact with the third sheet and to be driven to rotate by movement of the third sheet; a second roller configured to come into contact with the first sheet and to be driven to rotate by movement of the first sheet; a roll-up member disposed upstream of the first roller and configured to roll up (Continued)

the second sheet; and a transmission mechanism configured to transmit a rotational force of the first roller to the roll-up member.

14 Claims, 7 Drawing Sheets

(51) Int. Cl.
*B65H 18/02* (2006.01)
*B65H 16/10* (2006.01)

PRINT MEDIUM FEEDING DEVICE

CROSS-REFERENCE TO RELATED APPLICATION

This application claims priority from Japanese Patent Application No. 2020-062052 filed on Mar. 31, 2020, the content of which is incorporated herein by reference in its entirety.

TECHNICAL FIELD

The present disclosure relates to a print medium feeding device.

BACKGROUND

A known printer includes a pair of roller holders capable of feeding a printing target sheet to be printed that is rolled around a sheet roll. The pair of roller holders rotatably support the sheet roll around which the printing target sheet is rolled. The printer performs printing on the printing target sheet fed by the pair of roller holders.

A composite roll in which stencil paper, interleaving paper and thermal carbon paper are superposed and rolled into a roll shape may be used as a print medium. In order to perform printing using the composite roll, it is necessary to remove the interleaving paper in the middle of a feed path of the print medium, and then superpose the stencil paper and the thermal carbon paper on each other again and feed the stencil paper and the thermal carbon paper to a printing device.

SUMMARY

An object of the present disclosure is to provide a print medium feeding device capable of feeding only sheets necessary for printing performed by a printing device, which are included in a print medium in which a plurality of sheets are superposed.

A print medium feeding device according to a first aspect of the present disclosure is configured to feed a print medium including a first sheet, a second sheet, and a third sheet to a printing device. The print medium is in a state in which the first sheet, the second sheet, and the third sheet are superposed. The print medium feeding device is configured to remove the second sheet from the print medium to superpose the first sheet and the third sheet, and to feed the first sheet and the third sheet that are superposed to the printing device. The print medium feeding device includes: a first roller configured to come into contact with the third sheet and to be driven to rotate by movement of the third sheet; a second roller disposed at a position facing the first roller, and configured to come into contact with the first sheet and to be driven to rotate by movement of the first sheet; a roll-up member disposed upstream of the first roller in a conveyance direction of the first sheet and configured to roll up the second sheet; and a transmission mechanism configured to transmit a rotational force of the first roller to the roll-up member.

In the print medium feeding device, the rotational force of the first roller driven to rotate by the movement of the third sheet is transmitted to the roll-up member that rolls up the second sheet by the transmission mechanism. That is, the second sheet is rolled up by the roll-up member by the movement of the third sheet. Therefore, the print medium feeding device can feed only sheets necessary for printing performed by the printing device, which are included in the print medium in which a plurality of sheets are superposed.

A print medium feeding device according to a second aspect of the present disclosure is configured to feed a print medium including at least a first sheet and a second sheet to a printing device. The print medium is in a state in which the at least the first sheet and the second sheet are superposed. The print medium feeding device includes: a housing; a mounting portion provided in the housing and configured to detachably mount the printing device; an accommodation portion provided in the housing and configured to accommodate the print medium; a guide mechanism disposed between the mounting portion and the accommodation portion, the guide mechanism including a first roller configured to be driven to rotate by at least movement of the first sheet that is caused by a printing operation of the printing device; a roll-up member disposed between the first roller of the guide mechanism and the accommodation portion, the roll-up member being configured to roll up the second sheet; and a transmission mechanism configured to transmit a rotational force of the first roller to the roll-up member.

In the print medium feeding device, the second sheet is rolled up by the roll-up member in a process in which at least the first sheet moves toward the first roller of the guide mechanism. Therefore, the print medium feeding device can feed only sheets necessary for printing performed by the printing device, which are included in the print medium in which a plurality of sheets are superposed.

A print medium feeding device according to a third aspect of the present disclosure is configured to feed a print medium including a first sheet, a second sheet, and a third sheet to a printing device. The print medium is in a state in which the first sheet, the second sheet, and the third sheet are superposed. The print medium feeding device includes: a housing; a mounting portion provided in the housing and configured to detachably mount the printing device; an accommodation portion provided in the housing and configured to accommodate the print medium; a guide mechanism disposed between the mounting portion and the accommodation portion and configured to sandwich the first sheet and the third sheet, the guide mechanism including a first roller configured to be driven to rotate by movement of the first sheet and the third sheet that is caused by a printing operation of the printing device; a roll-up member disposed between the first roller of the guide mechanism and the accommodation portion and configured to roll up the second sheet; a transmission mechanism configured to transmit a rotational force of the first roller to the roll-up member; a first guide member provided in a first conveyance path, the first conveyance path extending from the accommodation portion to the first roller and being configured to allow the first sheet to be conveyed along the first conveyance path such that the first sheet moves on a first side in an orthogonal direction orthogonal to a longitudinal direction of the roll-up member; and a second guide member provided in a second conveyance path and a third conveyance path, the second conveyance path extending from the accommodation portion to the roll-up member and being configured to allow the second sheet to be conveyed along the second conveyance path, the third conveyance path extending from the accommodation portion to the first roller and being configured to allow the third sheet to be conveyed along the third conveyance path such that the third sheet moves on a second side opposite to the first side in the orthogonal direction with respect to the roll-up member.

In the print medium feeding device, the second sheet is rolled up by the roll-up member in a process in which the first sheet and the third sheet are conveyed toward the first roller of the guide mechanism. Therefore, the print medium feeding device can feed only sheets necessary for printing performed by the printing device, which are included in the print medium in which a plurality of sheets are superposed.

DETAILED DESCRIPTION

An embodiment of the present disclosure will be described with reference to drawings. The drawings to be referred to are used to describe technical features that the present disclosure may employ, and a configuration of a device described and the like are merely illustrative examples, and are not intended to limit the scope of the disclosure. In description of the present embodiment, a lower left side, an upper right side, a lower right side, an upper left side, an upper side and a lower side in FIG. 1 are respectively a front side, a rear side, a right side, a left side, an upper side and a lower side of a print medium feeding device (hereafter referred to as a "feeding device 1").

The feeding device 1 will be described with reference to FIGS. 1 to 6. The feeding device 1 is a device that feeds a print medium S to a printing device 100. The print medium S includes a printing target sheet S1, a protective sheet S2, and an ink sheet S3 which are superposed in turn (see FIG. 7). The feeding device 1 removes the protective sheet S2 from the print medium S, superposes the printing target sheet S1 and the ink sheet S3, and feeds the printing target sheet S1 and the ink sheet S3 that are superposed to the printing device 100.

Figure 1:
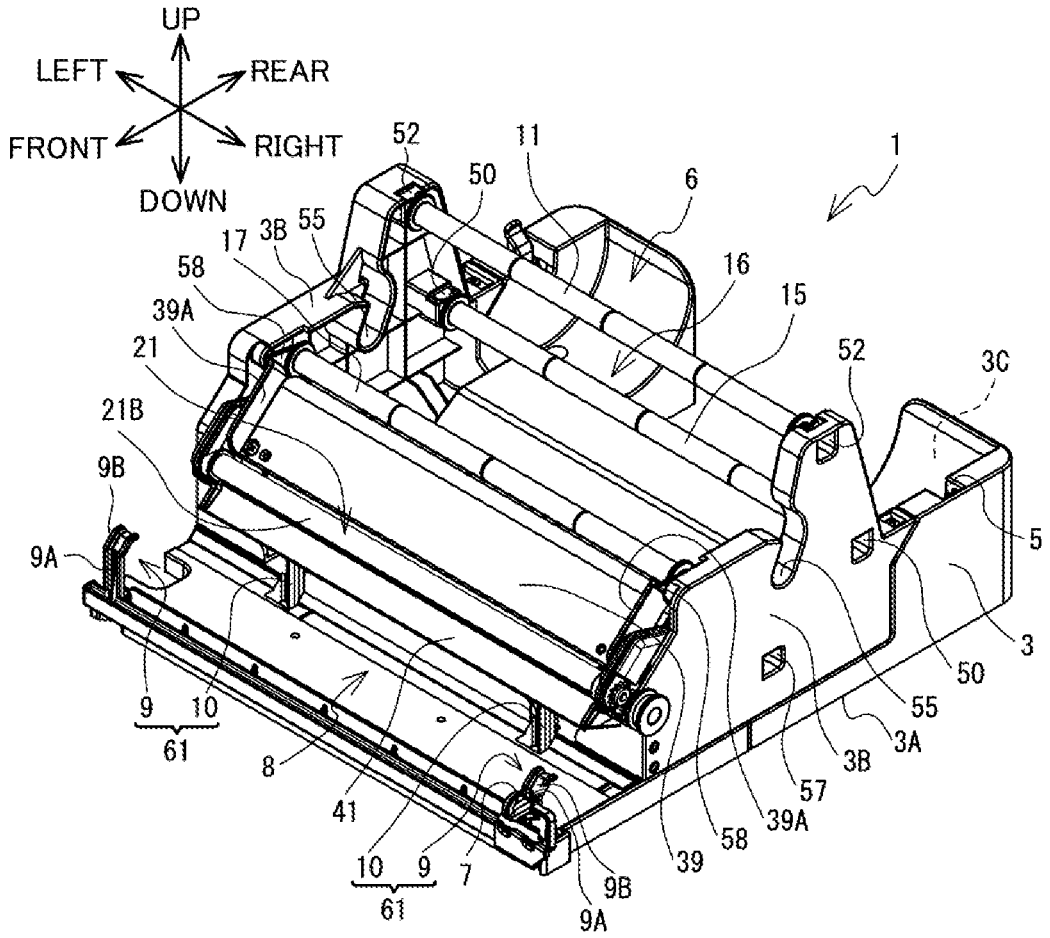
FIG. 1 is a perspective view of a feeding device 1.

As shown in FIG. 1, the feeding device 1 includes a housing 3, an accommodation portion 6, a conveyance mechanism 16, an inclined surface 39, a guide mechanism 21, a guide receiving surface 41, a mounting portion 8, a cutting mechanism 7 and the like. The housing 3 includes a bottom wall portion 3A having a substantially square shape in a plan view, a pair of side wall portions 3B and a pair of rear wall portions 3C. The pair of side wall portions 3B are provided at both end portions of the bottom wall portion 3A in a left-right direction. The pair of side wall portions 3B are erected upward from the end portions of the bottom wall portion 3A in the left-right direction. Each of the pair of side wall portions 3B has a substantially convex shape in a right side view. The pair of rear wall portions 3C are erected upward from left and right rear end portions of respective bottom wall portions 3A.

The accommodation portion 6 is provided at the rear of the housing 3. The accommodation portion 6 has a downwardly curved shape. The accommodating portion 6 can accommodate the print medium S rolled in a roll shape in the curved portion (see FIG. 2). Hereinafter, the print medium S is also referred to as a "roll R". A receiving portion 5 is provided on a rear side of the housing 3. The receiving portion 5 is a recess for supporting a flange member 85 described later.

<Roller>

The conveyance mechanism 16 includes a common roller 15, an upper support roller 11, a lower support roller 13 (see FIG. 7), a roll-up roll 29 (see FIG. 7), a merging roller 17 and the like. The common roller 15 is a roller whose axial direction extends in the left-right direction. The common roller 15 is provided on a rear side of the side wall portion 3B. The common roller 15 is disposed on a front side of the accommodation portion 6. End portions of the common roller 15 in the left-right direction are rotatably supported by respective bearing portions 50 of the pair of side wall portions 3B. The common roller 15 rotates counterclockwise in the right side view to guide the protective sheet S2 and the ink sheet S3.

The upper support roller 11 is a roller whose axial direction extends in the left-right direction. Both end portions 11A of the upper support roller 11 are rotatably supported by bearing portions 52 at respective upper end portions of the pair of side wall portions 3B. The upper support roller 11 rotates counterclockwise in the right side view to guide the printing target sheet S1.

Figure 2:
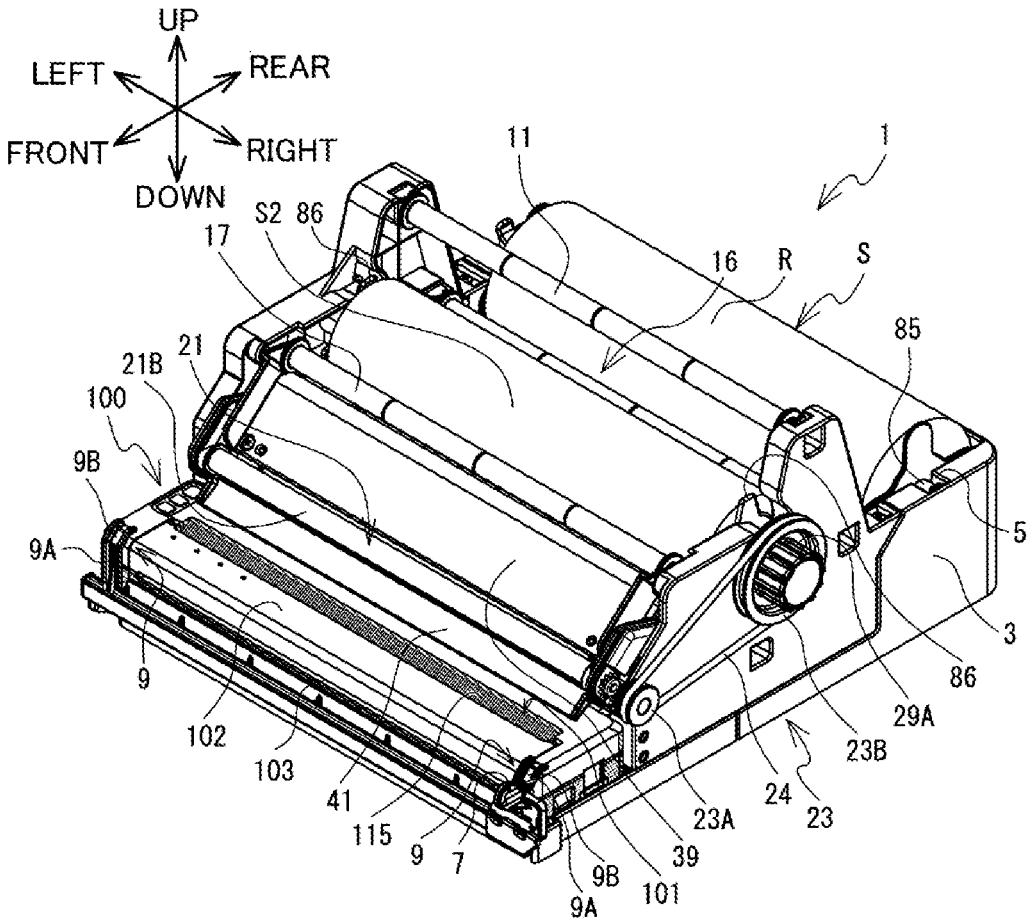
FIG. 2 is a perspective view of the feeding device 1 to which a print medium S, a roll-up roll 29, and a printing device 100 are attached.
Figure 3:
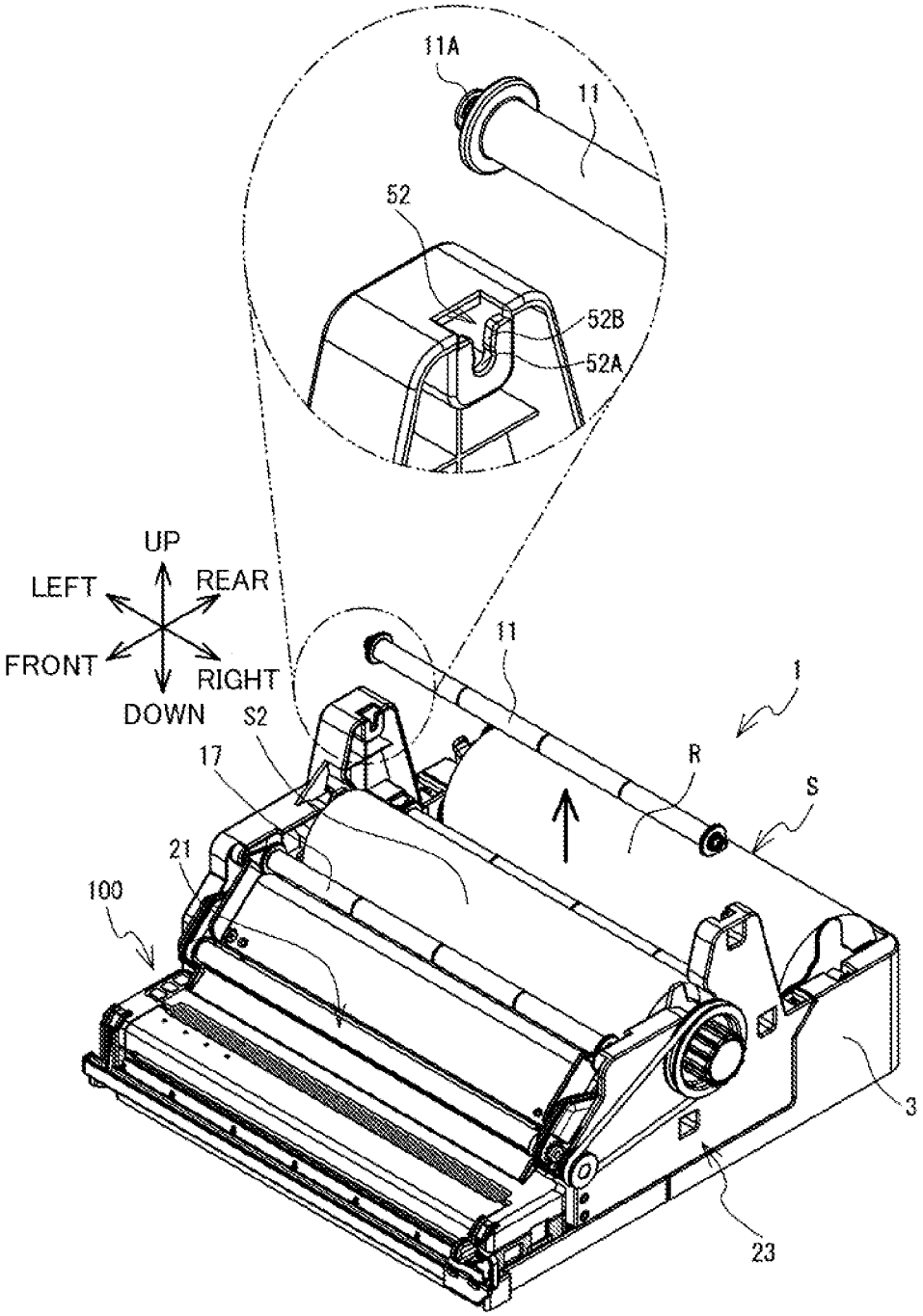
FIG. 3 is an enlarged perspective view of a periphery of a bearing portion 52 when an upper support roller 11 is in a non-guide position.

The upper support roller 11 can be switched between a guide position (see FIGS. 1 and 2) and a non-guide position (see FIG. 3). The guide position is a position where the upper support roller 11 is mounted on the bearing portions 52 to guide the printing target sheet S1. The non-guide position is a position where the upper support roller 11 is detached from the bearing portions 52 and away from the guide position. A user switches the upper support roller 11 between the guide position and the non-guide position by attaching and detaching the left and right end portions of the upper support roller 11 to and from the bearing portions 52.

At the guide position, the both end portions 11A of the upper support roller 11 are columnar, and are rotatably mounted on bottom portions 52A (see FIG. 3) provided at the upper end portions of the pair of side wall portions 3B. A guide portion 52B (see FIG. 3) extends from the upper end portion of each of the pair of side wall portions 3B toward the lower bottom portion 52A. The guide portion 52B has facing walls facing each other in a front-rear direction. A dimension between the facing walls is slightly smaller than an outer diameter of each of the both end portions 11A of the upper support roller 11. The bottom portion 52A has a substantially C shape whose upper side is open, and is slightly larger than the outer diameter of each of the both end portions 11A. The pair of side wall portions 3B provided with the guide portions 52B are made of a synthetic resin material, and the guide portion 52B is slightly elastically deformable. The user presses the both end portions 11A of the upper support roller 11 at the non-guide position from above the guide portions 52B to push and expand the guide portions 52B, and causes the both end portions 11A to pass through the guide portions 52B to reach the bottom portions 52A. When the both end portions 11A reach the bottom portions 52A, the guide portions 52B expanded by elastic deformation returns to an original state, and thus the both end portions 11A are held by the bottom portions 52A. The user can remove the upper support roller 11 from the guide portions 52B by lifting the upper support roller 11 at the guide position upward with an appropriate force.

The lower support roller 13 (see FIG. 7) has an axial direction extending in the left-right direction. The lower support roller 13 is disposed substantially at a center of the housing 3 in the front-rear direction and below the common roller 15 in an upper-lower direction. End portions of the lower support roller 13 in the left-right direction is rotatably supported by bearing portions 57 of the pair of side wall portions 3B (see FIG. 1). The lower support roller 13 rotates clockwise in the right side view to guide the protective sheet S2 and the ink sheet S3.

The roll-up roll 29 (see FIG. 7) is a roll that rolls up the protective sheet S2, and an axial direction thereof extends in the left-right direction. The roll-up roll 29 is disposed substantially at respective center portions of the pair of side wall portions 3B. Although not shown in detail, the roll-up roll 29 is provided with flange members 86 (see FIG. 2) at both end portions. The flange members 86 are rotatably supported by bearing portions 55 of the pair of side wall portions 3B (see FIG. 1). The roll-up roll 29 rotates counterclockwise in the right side view to roll up the protective sheet S2. The roll-up roll 29 is provided between the upper support roller 11 and the lower support roller 13 in the upper-lower direction (see FIG. 7). The roll-up roll 29 is disposed behind a first roller 21A described later in the front-rear direction (see FIG. 7).

The merging roller 17 has an axial direction extending in the left-right direction. The merging roller 17 is disposed at the upper end portions at the front of the pair of side wall portions 3B. End portions of the merging roller 17 in the left-right direction are rotatably supported by support portions 58. The merging roller 17 rotates counterclockwise in the right side view to guide the printing target sheet S1 and the ink sheet S3. The support portions 58 are portions extending rearward from rear ends of side plates 39A erected from both left and right end portions of the inclined surface 39. The inclined surface 39 is a rectangular plate member that is long in the left-right direction in the plan view. A rear end portion of the inclined surface 39 is located below a lower end portion of the merging roller 17. The inclined surface 39 is inclined downward to the front toward a front end portion. The pair of left and right side plates 39A guide left and right edges of the printing target sheet S1 and the ink sheet S3, respectively.

<Guide Mechanism 21>

The guide mechanism 21 includes a pair of nip rollers and a switching mechanism 31. The pair of nip rollers include the first roller 21A and a second roller 21B. The first roller 21A and the second roller 21B each have an elongated columnar shape extending in the left-right direction. The first roller 21A is provided below a lower end portion of the inclined surface 39. The second roller 21B is provided in front of the lower end portion of the inclined surface 39.

Lengths of the first roller 21A and the second roller 21B in the left-right direction that is an axial direction are longer than a width of the print medium S in the left-right direction. Diameters of the first roller 21A and the second roller 21B are the same. The first roller 21A is disposed so as to face a lower surface of the second roller 21B. Both end portions of the first roller 21A in the left-right direction are rotatably supported by front end portions of the pair of side wall portions 3B. The first roller 21A comes into contact with the ink sheet S3 and is driven to rotate by movement of the ink sheet S3.

The switching mechanism 31 includes a pair of support arm portions 32. Rear end portions of the pair of support arm portions 32 are rotatably supported inside the pair of side wall portions 3B on an upper rear side of the first roller 21A. The pair of support arm portions 32 are rotatable about the rear end portions thereof. End portions of the second roller 21B in the left-right direction are rotatably provided at front end portions of the pair of support arm portions 32.

Figure 4:
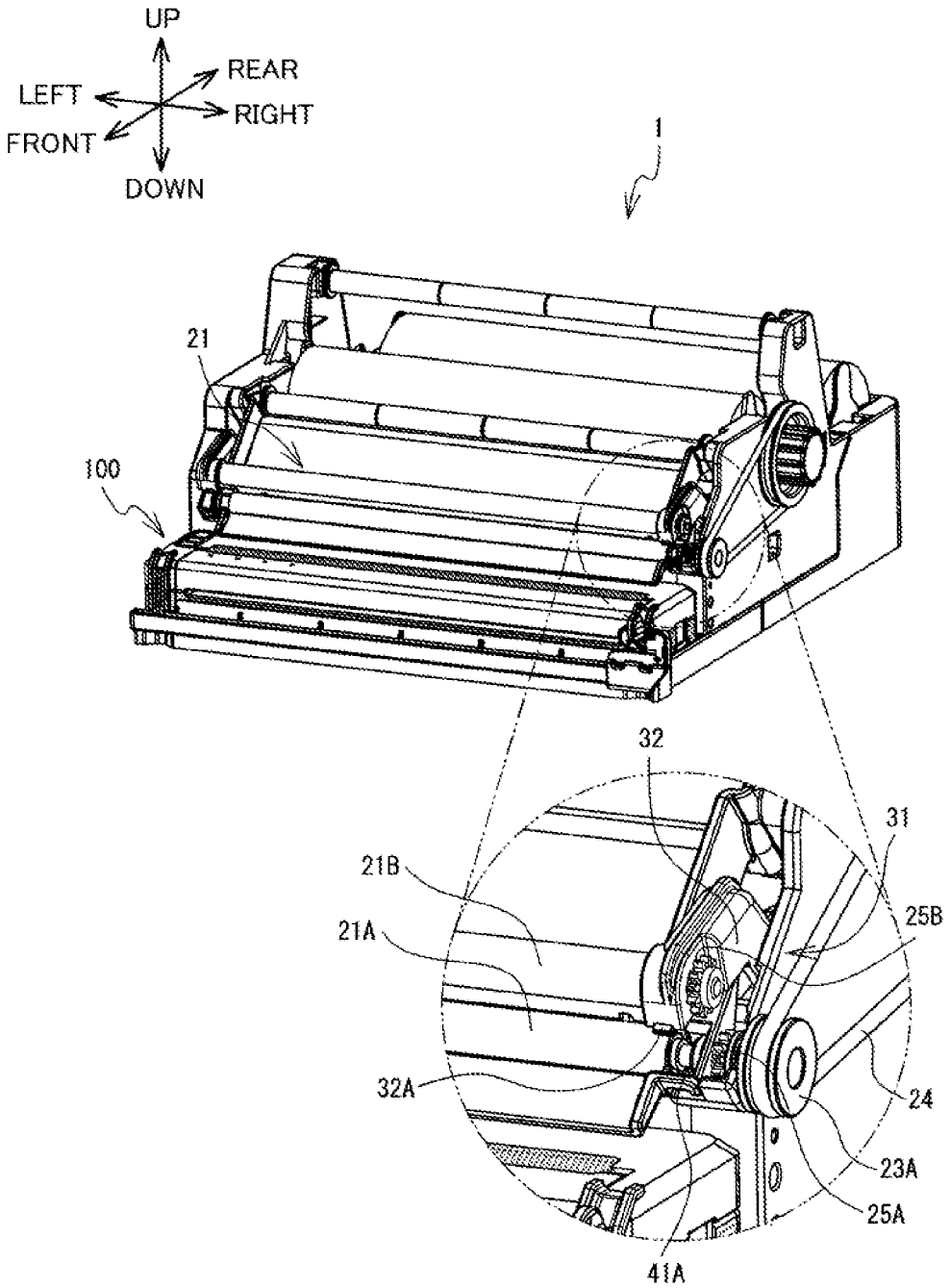
FIG. 4 is an enlarged perspective view of a periphery of a switching mechanism 31 when a second roller 21B is in a retracted position.
Figure 5:
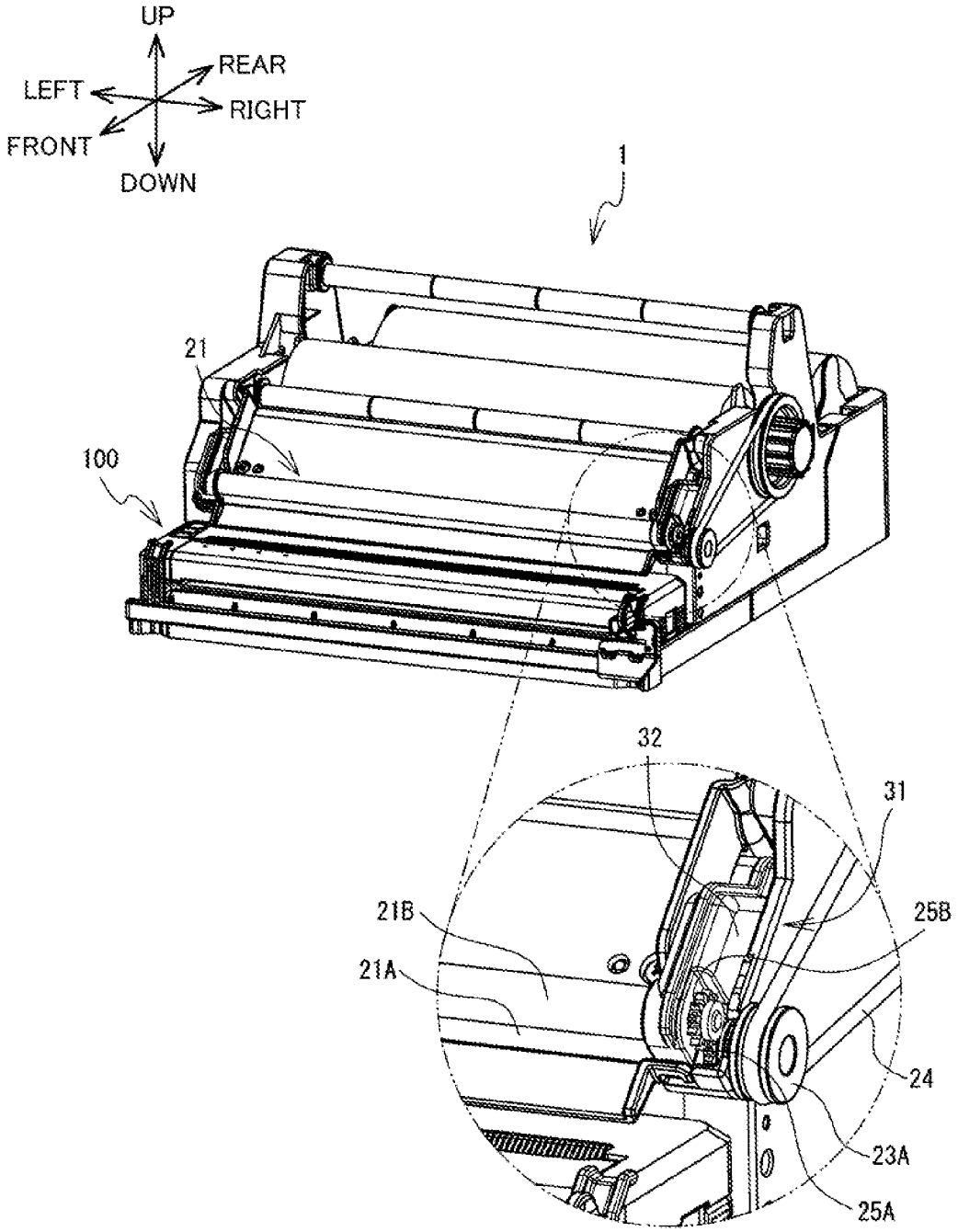
FIG. 5 is an enlarged perspective view of the periphery of the switching mechanism 31 when the second roller 21B is in a sandwiching position.

The second roller 21B is movable to a sandwiching position (see FIG. 5) and a retracted position (see FIG. 4) by rotation of the pair of support arm portions 32 of the switching mechanism 31. The sandwiching position is a position where the second roller 21B sandwiches the print medium S with the first roller 21A (see FIG. 7B). The retracted position is a position where the second roller 21B is upwardly away from the first roller 21A. The switching mechanism 31 switches a position of the second roller 21B between the sandwiching position and the retracted position, and rotatably supports the second roller 21B. As shown in FIG. 4, small protrusions 32A is respectively provided at the front end portions of the pair of support arm portions 32. Both left and right end portions of the guide receiving surface 41 are respectively provided with small hook portions 41A that are engaged with the protrusions 32 A in a disengageable manner. The hook portion 41A is configured to be slightly elastically deformable. When the second roller 21B is at the sandwiching position, the protrusion 32A is engaged with the hook portion 41A, and the second roller 21B is held at the sandwiching position. When the second roller 21B is at the sandwiching position, if a force having an appropriate magnitude is applied in a direction of lifting the front end portions of the pair of support arm portions 32, the protrusion 32A is disengaged from the hook portion 41A and released from the holding state.

A first gear 25A is provided at the right end portion of the first roller 21A. A second gear 25B is provided at the right end portion of the second roller 21B. The first gear 25A and the second gear 25B are gears having the same pitch circle diameter and number of teeth. When the second roller 21B is at the sandwiching position, the first gear 25A of the first roller 21A and the second gear 25B of the second roller 21B mesh with each other.

A gear ratio of the first gear 25A to the second gear 25B is 1 to 1. The diameters of the first roller 21A and the second roller 21B are the same. Therefore, when the second roller 21B is at the sandwiching position, the first gear 25A and the second gear 25B mesh with each other and rotate, and the first roller 21A and the second roller 21B rotate at equal circumferential speeds.

While being disposed at the sandwiching position facing the first roller 21A, the second roller 21B comes into contact with the printing target sheet S1 and is driven to rotate by movement of the printing target sheet S1.

<Transmission Mechanism 23>

A transmission mechanism 23 will be described with reference to FIG. 2. The transmission mechanism 23 transmits a rotational force of the first roller 21A to the roll-up roll 29. The transmission mechanism 23 includes a first pulley 23A, a second pulley 23B, and a belt 24. The first pulley 23A is provided on a rotation shaft of the first roller 21A and is disposed on a right side of the first gear 25A. The first pulley 23A rotates integrally with the first roller 21A.

The second pulley 23B has an outer diameter larger than that of the first pulley 23A. The second pulley 23B is provided at the right end portion of the roll-up roll 29. More specifically, the second pulley 23B is provided on a right side of a portion where the flange member 86 of the roll-up roll 29 is supported by the bearing portion 55. The second pulley 23B rotates integrally with the roll-up roll 29.

The belt 24 is hung on the first pulley 23A and the second pulley 23B. The first pulley 23A transmits a driving force to the second pulley 23B by a frictional force with the belt 24. A slip amount of the first pulley 23A with respect to the belt 24 increases as a roll-up amount of the protective sheet S2 rolled up by the roll-up roll 29 increases. Thereby, the roll-up roll 29 can uniformly roll the protective sheet S2. More specifically, the protective sheet S2 rolled up by the roll-up roll 29 is rolled into a roll shape, but as an outer diameter of the roll increases, an amount of the protective sheet S2 rolled up by one rotation of the roll-up roll 29 increases. Therefore, in order to uniformly roll the protective sheet S2 by the roll-up roll 29, it is necessary to gradually slow down an rotation speed of the roll-up roll 29 rather than making the rotation speed constant. As will be described later, a constant tension is applied to the protective sheet S2 in a direction opposite to a pulling-out direction, that is, in a pulling-back direction. Accordingly, even when the first pulley 23A rotates at a constant rotation speed, the transmission mechanism 23 can increase the slip amount of the first pulley 23A with respect to the belt 24 as the roll-up amount of the protective sheet S2 increases, and gradually reduce the rotation speed of the roll-up roll 29 that rotates integrally with the second pulley 23B. Since the second pulley 23B has the outer diameter larger than that of the first pulley 23A, a contact length with the belt 24 is long. Therefore, even when the roll-up amount of the protective sheet S2 increases, the second pulley 23B and the belt 24 do not slip, but the first pulley 23A and the belt 24 slip.

The second pulley 23B includes a knob portion 29A protruding rightward in a substantially columnar shape. By rotating the knob portion 29A counterclockwise in the right side view, the user can roll up the protective sheet S2 to eliminate looseness of the protective sheet S2 with respect to the roll-up roll 29. Therefore, the user can eliminate the looseness and appropriately apply the tension to the protective sheet S2 by rotating the knob portion 29A in printing preparation described later.

The guide receiving surface 41 guides the printing target sheet S1 and the ink sheet S3 conveyed out by the first roller 21A to a sheet insertion slot 101 of the printing device 100 (see FIG. 2). An inclination angle of the guide receiving surface 41 is substantially the same as that of a receiving surface of the sheet insertion slot 101 of the printing device 100 described later. That is, the guide receiving surface 41 is a surface facing downward toward the front. Thereby, the fed printing target sheet S1 and the ink sheet S3 are easily inserted into the sheet insertion slot 101.

The mounting portion 8 is provided at a front end portion of the housing 3 (see FIG. 1). The mounting portion 8 is formed in a substantially rectangular parallelepiped shape that is long in the left-right direction. The printing device 100 can be mounted on the mounting portion 8 by being inserting from a left side. The mounting portion 8 includes a preventing portion 61. The preventing portion 61 includes a pair of front extension portions 9 and a pair of rear extension portions 10. The pair of front extension portions 9 are respectively provided on both left and right end portions of a front side of the mounting portion 8. The pair of rear extension portions 10 are respectively provided at positions slightly closer to a center from both left and right ends of a rear side of the mounting portion 8. Each of the pair of front extension portions 9 includes an erect portion 9A and a protruding portion 9B. The erect portion 9A is erected upward. The protruding portion 9B extends obliquely upward from an upper end of the erect portion 9A toward the rear, and then extends further rearward. Thereby, each of the pair of front extension portions 9 has a substantially inverted L shape. The pair of rear extension portions 10 extend upward. The printing device 100 mounted on the mounting portion 8 is sandwiched between the pair of front extension portions 9 and the pair of rear extension portions 10 from the front-rear direction, and the protruding portions 9B abut on the mounting portion 8 from above. In this way, the preventing portion 61 prevents movement of the printing device 100 mounted on the mounting portion 8 in the front-rear direction and the upper-lower direction. Therefore, when the printing device 100 conveys the print medium S, a force in a direction opposite to the conveyance direction of the print medium S acts on the printing device 100, but the preventing portion 61 prevents the printing device 100 mounted on the mounting portion 8 from moving in the direction opposite to the conveyance direction of the print medium S.

The cutting mechanism 7 cuts the printing target sheet S1 and the ink sheet S3 discharged after printing from the printing device 100 mounted on the mounting portion 8. The cutting mechanism 7 (see FIGS. 1 and 2) is provided at a right front end portion of the housing 3. The cutting mechanism 7 includes a cutting blade (not shown). The user slides the cutting mechanism 7 to the left to cut the printing target sheet S1 and the ink sheet S3 discharged from a discharge slot 103 with the cutting blade.

<Roll Holding Member 70>

Figure 6:
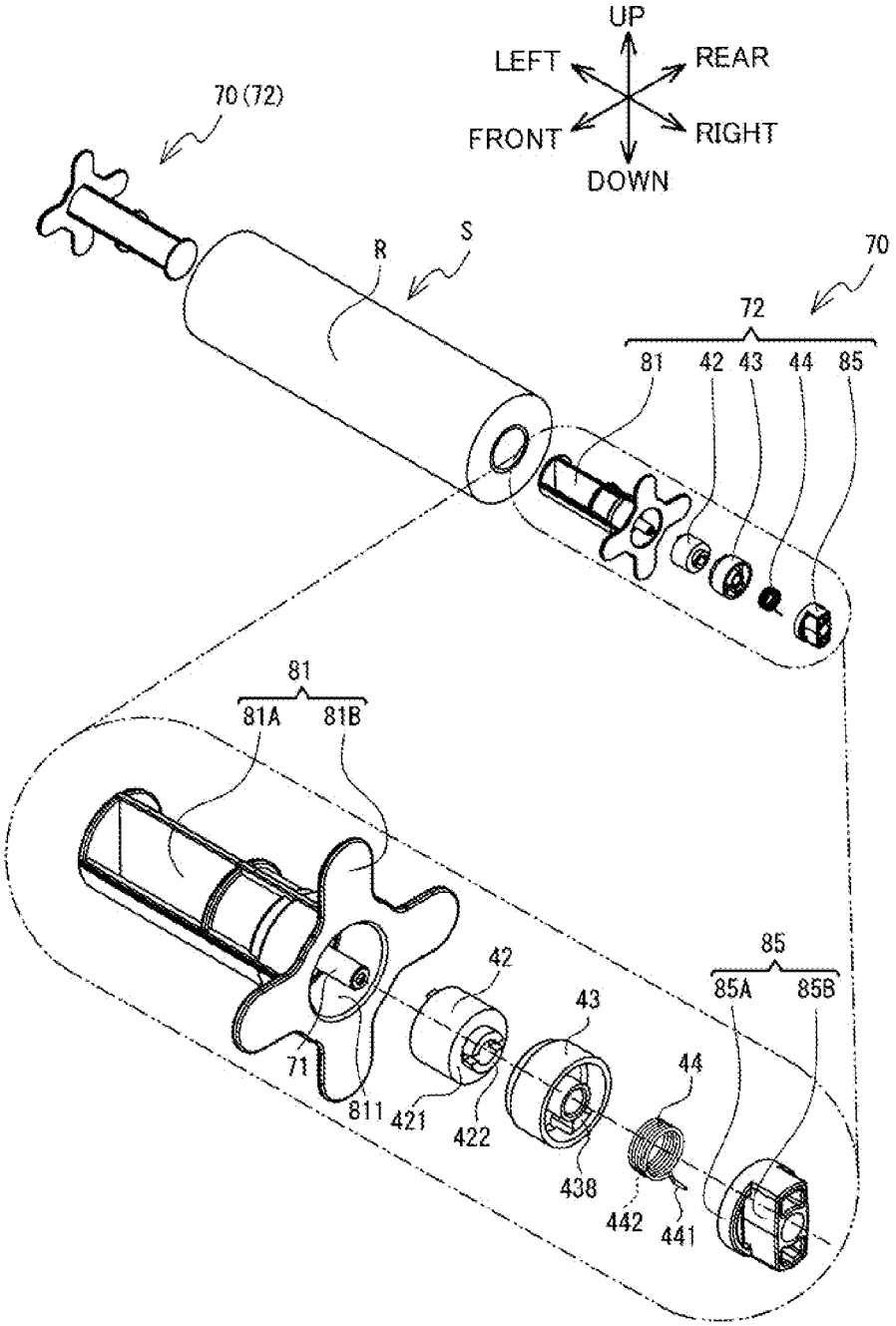
FIG. 6 is an enlarged perspective view of a roll holding member 70.

As shown in FIG. 6, the roll holding member 70 supporting the print medium S includes a rotation unit 72. Since two rotation units 72 are configured to be bilaterally symmetrical in the left-right direction, the right rotation unit 72 will be described below, and description of the left rotation unit 72 will be omitted. The rotation unit 72 includes a tube portion 81, a torque limiter 42, an intermediate member 43, a torsion spring 44 and the flange member 85 in this order from the left side.

The tube portion 81 includes a tubular portion 81A extending in the left-right direction and a substantially cross-shaped side plate portion 81B provided at a right end of the tubular portion 81A. The tubular portion 81A is engaged with inside of a core of the roll R around which the print medium S is rolled. The side plate portion 81B abuts on a right side surface of the roll R. A central shaft 71 extending rightward from a left bottom surface (not shown) of a hole 811 is provided at a center of the hole 811 inside the tubular portion 81A. A through hole penetrating in the left-right direction is formed in each of the torque limiter 42, the intermediate member 43 and the flange member 85, which are accommodated in the hole 811 in a state of being penetrated by the central shaft 71. At this time, a block portion 85B of the flange member 85 described later protrudes rightward from the side plate portion 81B.

The torque limiter 42 includes a main body wheel portion 421 and a driven wheel portion 422. The torque limiter 42 has a known structure in which when a torque input to one side exceeds a set torque, the other side slips. The main body wheel portion 421 of the torque limiter 42 is engaged with the hole 811 and rotates integrally with the tube portion 81. The driven wheel portion 422 of the torque limiter 42 is engaged with the intermediate member 43 and rotates integrally with the intermediate member 43. The intermediate member 43 is provided with an engagement protrusion 438. An action of the engagement protrusion 438 will be described later. A second arm portion 442 of the torsion spring 44 is locked to the intermediate member 43.

The flange member 85 includes a disc portion 85A and the block portion 85B having a substantially rectangular parallelepiped shape. A first arm portion 441 of the torsion spring 44 is locked to the flange member 85. The flange member 85 is rotatably supported by a right end portion of the central shaft 71. The block portion 85B of the flange member 85 is engaged with the receiving portion 5 of the housing 3 in a disengageable manner. Although not shown, a first protrusion and a second protrusion are provided at positions away from each other by a predetermined angle on a left side surface of the disc portion 85A. Actions of the first protrusion and the second protrusion will be described later.

When the print medium S is fed out from the roll R of the accommodation portion 6, the tube portion 81 starts to rotate clockwise in the right side view. Accordingly, the torque limiter 42 and the intermediate member 43 rotate integrally with the tube portion 81. Due to rotation of the intermediate member 43, the second arm portion 442 of the torsion spring 44 also rotates in the same direction. In this case, since the flange member 85 engaged with the first arm 441 of the torsion spring 44 is engaged with the receiving portion 5, so that the flange member 85 does not rotate. Thereby, the torsion spring 44 is bent in a rolling direction.

When the tube portion 81 further rotates clockwise in the right side view, the engagement protrusion 438 of the intermediate member 43 rotates and stops until the engagement protrusion 438 abuts on the first protrusion of the flange member 85. At this time, since the torsion spring 44 is bent in the rolling direction, the torsion spring 44 urges the intermediate member 43 in a rolling-back direction, that is, in a counterclockwise direction in the right side view.

When the engagement protrusion 438 abuts on the first protrusion, the rotation of the intermediate member 43 is stopped. However, since the tube portion 81 continues to rotate, a torque exceeding the set torque is applied to the torque limiter 42. At this time, the main body wheel portion 421 starts to slide with respect to the driven wheel portion 422 of the torque limiter 42. Thereby, while the print medium S is pulled out forward from the roll R, the roll holding member 70 applies a constant tension to the print medium S by the set torque of the torque limiter 42. Therefore, a force when pulling out the print medium S does not vary depending on an outer diameter of the roll R, that is, a rolling length of the print medium S, and the roll holding member 70 can stabilize conveyance accuracy of the print medium S.

When the pulling-out of the print medium S is stopped, the tension applied by the torque limiter 42 is released. In this case, an urging force of the torsion spring 44 causes the engagement protrusion 438 of the intermediate member 43 to rotate from a position abutting on the first protrusion of the flange member 85 to a position abutting on the second protrusion. That is, the intermediate member 43 rotates counterclockwise in the right side view due to the urging force of the torsion spring 44. Thereby, the torque limiter 42 and the tube portion 81 also rotate counterclockwise in the right side view. That is, the print medium S can be rolled back by reversing the rotation unit 72. Therefore, in the feeding device 1, an occurrence of looseness in the print medium S can be prevented.

<Printing Device 100>

As shown in FIG. 2, the printing device 100 has a substantially rectangular parallelepiped shape long in the left-right direction. The printing device 100 includes a conveyance roller 111, a thermal head 112 and the like inside a main body cover 102.

The conveyance roller 111 is disposed so as to face the heat generation resistor of the thermal head 112 from above. The conveyance roller 111 rotates clockwise in the right side view to convey the printing target sheet S1 and the ink sheet S3. The thermal head 112 performs printing on the printing target sheet S1 by heating the ink sheet S3 by selectively conducting a plurality of heating elements.

<Conveyance Path>

Figure 7A:
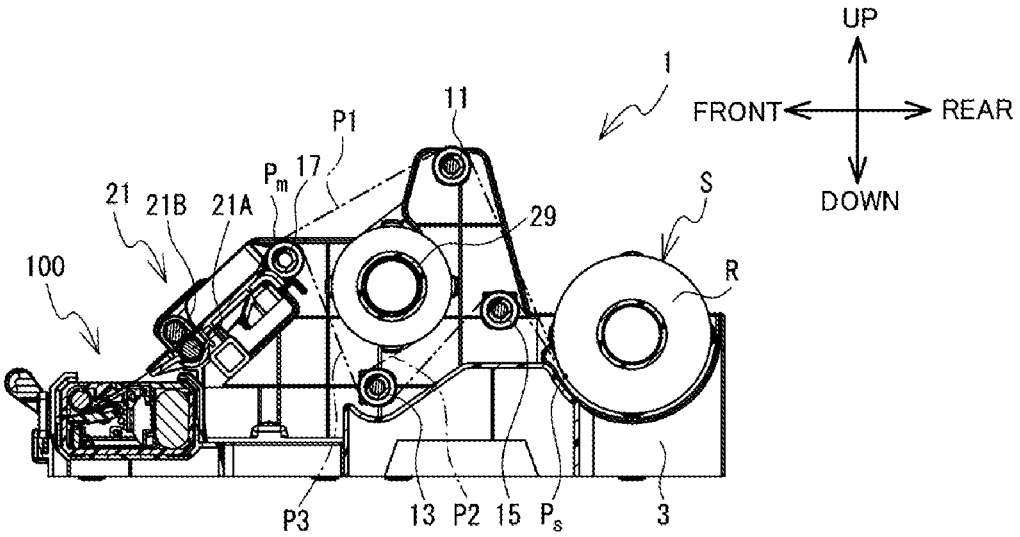
FIG. 7A is a view showing a first conveyance path P1, a second conveyance path P2 and a third conveyance path P3.
Figure 7B:
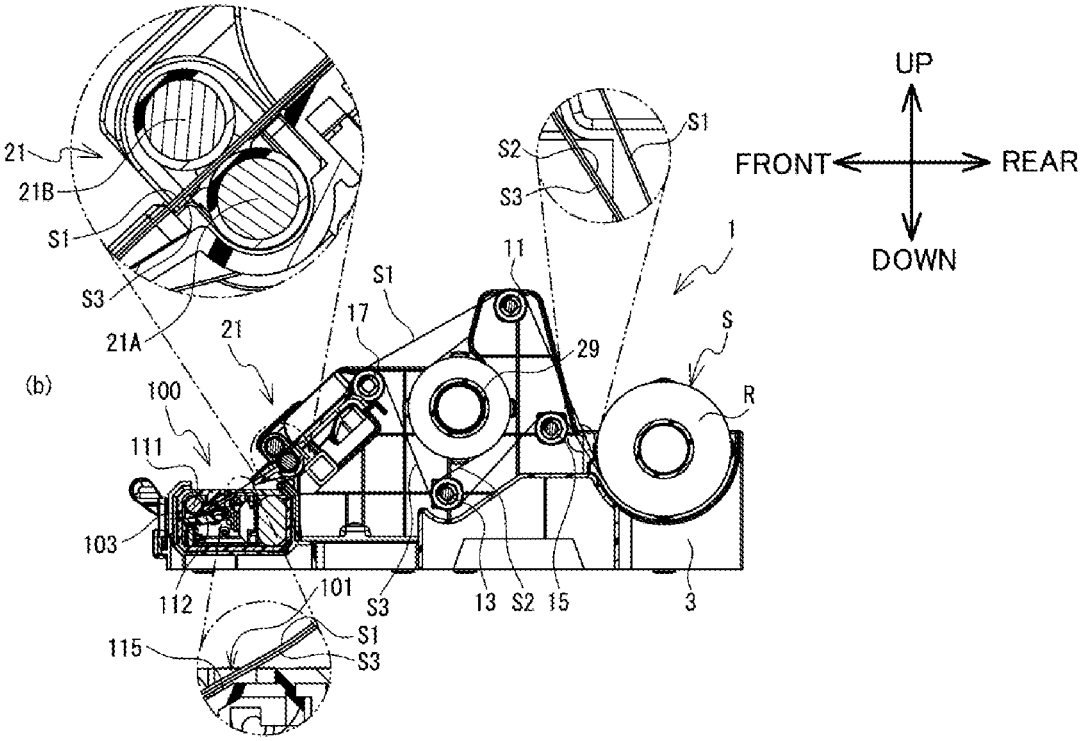
FIG. 7B is a view showing a mode in which a printing target sheet S1, a protective sheet S2 and an ink sheet S3 move.

A first conveyance path P1, a second conveyance path P2 and a third conveyance path P3 will be described with reference to FIG. 7A. The first conveyance path P1 is a path along which the printing target sheet S1 is conveyed. The second conveyance path P2 is a path along which the protective sheet S2 is conveyed. The third conveyance path P3 is a path along which the ink sheet S3 is conveyed.

The first conveyance path P1 is a path that extends from the accommodation portion 6 to the first roller 21A. The first conveyance path P1 is a path that passes through an upper surface of the upper support roller 11, an upper surface of the merging roller 17, the inclined surface 39 and an upper surface of the first roller 21A. The upper support roller 11 is disposed above the roll-up roll 29, and the merging roller 17 is disposed in front of the roll-up roll 29. Therefore, the first conveyance path P1 is a path that is bent toward an upper side where the upper support roller 11 is disposed.

The second conveyance path P2 is a path that extends from the accommodation portion 6 to the roll-up roll 29. The second conveyance path P2 is a path that passes through an upper surface of the common roller 15 and a lower surface of the lower support roller 13 to reach a lower surface of the protective sheet S2 rolled up by the roll-up roll 29.

The third conveyance path P3 is a path that extends from the accommodation portion 6 to the first roller 21A. The third conveyance path P3 is a path that passes through the upper surface of the common roller 15, the lower surface of the lower support roller 13, the upper surface of the merging roller 17 and the upper surface of the first roller 21A. A path of the third conveyance path P3 from the accommodation portion 6 to the lower support roller 13 is common to the second conveyance path P2.

The common roller 15 is disposed between the roll-up roll 29 and the accommodation portion 6. The lower support roller 13 is disposed at a position away from the common roller 15 downward to the front. Thereby, the common path of the second conveyance path P2 and the third conveyance path P3 includes a path extending from the accommodation portion 6 to the lower support roller 13, the path being bent upward by the common roller 15.

The lower support roller 13 is disposed at the position downwardly away from the roll-up roll 29. The merging roller 17 is disposed at a position forwardly away from the roll-up roll 29. Thereby, the third conveyance path P3 includes a path extending from the common roller 15 to the merging roller 17, the path being bent downward.

In the first conveyance path P1 and the third conveyance path P3, the printing target sheet S1 is separated from the protective sheet S2 and the ink sheet S3 at a position Ps, and the printing target sheet S1 and the ink sheet S3 are merged at a position Pm. The merging roller 17 is provided at a position where the first conveyance path P1 and the third conveyance path P3 have the same length in paths from the position Ps to the position Pm.

<Printing Preparation of Print Medium S>

The user prepares printing before performing printing processing. The user pulls out the print medium S from the roll R accommodated in the accommodation portion 6, and sets the print medium S in a printable state. The user sets the printing target sheet S1 so as to pass through the first conveyance path P1. The user sets the protective sheet S2 so as to pass through the second conveyance path P2. In addition, the user sets the protective sheet S2 in a state in which a leading end portion of the protective sheet S2 is rolled around the roll-up roll 29. In this case, the user can apply a certain tension to the protective sheet S2 to eliminate the looseness by turning the knob portion 29A.

The user sets the ink sheet S3 so as to pass through the third conveyance path P3. The user merges a leading end portion of the ink sheet S3 with a leading end portion of the printing target sheet S1 at the merging roller 17. Thereby, the printing target sheet S1 and the ink sheet S3 are superposed on each other.

The user causes the printing target sheet S1 and the ink sheet S3 to pass through the inclined surface 39, the upper surface of the first roller 21A of the guide mechanism 21, and the guide receiving surface 41 in a state in which the leading end portions of the printing target sheet S1 and the ink sheet S3 are superposed on each other. The user inserts the printing target sheet S1 and the ink sheet S3 that have passed through the guide receiving surface 41 into the sheet insertion slot 101 of the printing device 100. The user moves the printing target sheet S1 and the ink sheet S3 that are inserted through the sheet insertion slot 101 further downward to the front, and causes the printing target sheet S1 and the ink sheet S3 to pass through the conveyance roller 111 and the thermal head 112 at facing positions. Thereby, the printing device 100 is in a state in which the printing target sheet S1 and the ink sheet S3 can be discharge toward the discharge slot 103 by rotation of the conveyance roller 111. Thereby, the printing preparation for the printing device 100 is completed.

<Printing Operation>

A printing operation of the printing device 100 and feeding of the print medium S by the feeding device 1 will be described. When the printing device 100 is powered on and the printing operation is started, the conveyance roller 111 is rotationally driven. The printing target sheet S1 and the ink sheet S3 are discharged toward the discharge slot 103 by the conveyance roller 111. At this time, the printing device 100 prints characters on the printing target sheet S1 by the thermal head 112 heating the ink sheet S3. When the printing target sheet S1 and the ink sheet S3 are conveyed downward to the front, a reaction force upward to the rear acts on the printing device 100, but the printing device 100 is prevented from moving upward to the rear by the preventing portion 61. Therefore, the printing device 100 is stably supported by the mounting portion 8.

<Conveyance of Print Medium S>

Since the printing device 100 moves the printing target sheet S1 and the ink sheet S3 downward to the front by performing printing, the print medium S is fed out from the roll R accommodated in the accommodation portion 6. The printing target sheet S1, the protective sheet S2 and the ink sheet S3 fed out from the roll R respectively move through the first conveyance path P1, the second conveyance path P2 and the third conveyance path P3. The printing target sheet S1 fed out from the accommodation portion 6 is separated from the protective sheet S2 at the position Ps, and moves toward the upper surface of the upper support roller 11. The printing target sheet S1 moves toward the upper surface of the upper support roller 11, and then moves toward the merging roller 17.

After being separated from the printing target sheet S1, the protective sheet S2 and the ink sheet S3 move toward the common roller 15 and move from the upper surface of the common roller 15 toward the lower surface of the lower support roller 13. The protective sheet S2 that has moved to the lower surface of the lower support roller 13 is separated from the ink sheet S3 and moves upward to the rear toward the lower surface of the roll-up roll 29. The roll-up roll 29 is rotated counterclockwise in the right side view by driving of the transmission mechanism 23. Thereby, the protective sheet S2 is rolled around the roll-up roll 29.

On the other hand, the ink sheet S3 moves upward to the front from the lower support roller 13 toward the upper surface of the merging roller 17. The ink sheet S3 that has moved to the merging roller 17 is superposed on the printing target sheet S1 at the position Pm of the merging roller 17. Here, the first conveyance path P1 and the third conveyance path P3 are set to the same distance. Therefore, the leading end portion of the printing target sheet S1 separated at the position Ps and the leading end portion of the ink sheet S3 are superposed again at the position Pm.

The printing target sheet S1 and the ink sheet S3 move forward and downward on the inclined surface 39 toward a position between the first roller 21A and the second roller 21B of the guide mechanism 21 in a state of being superposed at the position Pm of the merging roller 17.

The printing target sheet S1 and the ink sheet S3 that have passed through the guide mechanism 21 pass through the guide receiving surface 41. The printing target sheet S1 and the ink sheet S3 that have passed through the guide receiving surface 41 are guided to an insertion surface 115 of the sheet insertion slot 101 of the printing device 100. The printing target sheet S1 and the protective sheet S2 guided by the insertion surface 115 move toward the thermal head 112 inside the printing device 100.

The ink sheet S3 moves to the discharge slot 103 together with the printing target sheet S1 printed by the thermal head 112. The printing target sheet S1 after printing and the used ink sheet S3 are discharged from the discharge portion 105 to outside of the printing device 100 and are cut by the cutting mechanism 7.

Functions and Effects of Present Embodiment

As described above, in the feeding device 1, the protective sheet S2 is rolled up by the roll-up roll 29 in a process in which the printing target sheet S1 and the ink sheet S3 move toward the first roller 21A of the guide mechanism 21. Therefore, the feeding device 1 can feed only sheets necessary for printing performed by the printing device 100, which are included in the print medium S in which a plurality of sheets are superposed.

A length of the first conveyance path P1 and a length of the third conveyance path P3 are the same. Therefore, the leading end portions of the printing target sheet S1 and the protective sheet S2 can be superposed again on each other.

The common roller 15 is disposed at a position away from the lower support roller 13 in the upper-lower direction, and is provided in the second conveyance path P2 and the third conveyance path P3 between the accommodation portion 6 and the lower support roller 13. The second conveyance path P2 and the third conveyance path P3 include the path extending from the accommodation portion 6 to the lower support roller 13, the path being bent in the upper-lower direction by the common roller 15. In the feeding device 1, since the second conveyance path P2 and the third conveyance path P3 form the path bent in the upper-lower direction by the common roller 15, lengths of the second conveyance path P2 and the third conveyance path P3 in the front-rear direction can be shortened. Therefore, in the feeding device 1, a size of the housing 3 in the front-rear direction can be reduced.

The merging roller 17 is provided at a position where the first conveyance path P1 and the third conveyance path P3 merge. In the feeding device 1, the printing target sheet S1 and the ink sheet S3 can be guided by the merging roller 17.

The upper support roller 11, the lower support roller 13, the common roller 15 and the merging roller 17 are rollers. In the feeding device 1, when the print medium S is conveyed, the rollers rotate as the print medium S moves. Therefore, in the feeding device 1, the print medium S can be smoothly guided.

The transmission mechanism 23 includes the first pulley 23A, the second pulley 23B, the belt 24 and the like. The first pulley 23A rotates integrally with the first roller 21A. The second pulley 23B has the outer diameter larger than that of the first pulley 23A and rotates integrally with the roll-up roll 29. The belt 24 is hung on the first pulley 23A and the second pulley 23B. The first pulley 23A transmits the driving force to the second pulley 23B by the frictional force with the belt 24. In the feeding device 1, since the outer diameter of the second pulley 23B is larger than the outer diameter of the first pulley 23A, the slip amount of the belt 24 with respect to the first pulley 23A increases as the roll-up amount of the protective sheet S2 increases. Therefore, in the feeding device 1, the protective sheet S2 can be uniformly rolled around a roll-up shaft as the slip amount increases.

The guide mechanism 21 includes the second roller 21B facing the first roller 21A. The first roller 21A is rotatably supported by the housing 3. The switching mechanism 31 switches the position of the second roller 21B between the sandwiching position and the retracted position, and rotatably supports the second roller 21B. The sandwiching position is the position where the second roller 21B sandwiches the print medium S with the first roller 21A. The retracted position is the position where the second roller 21B is away from the first roller 21A. The first roller 21A includes a first gear 25A at the right end portion in the axial direction. The second roller 21B includes the second gear 25B at the right end portion in the axial direction. When the second roller 21B is located at the sandwiching position, the first gear 25A and the second gear 25B mesh with each other, whereby the first roller 21A and the second roller 21B rotate at the equal circumferential speeds. In the feeding device 1, since the circumferential speeds of the first roller 21A and the second roller 21B are equal, the printing target sheet S1 and the ink sheet S3 can be conveyed without being displaced.

The guide receiving surface 41 guides the printing target sheet S1 and the ink sheet S3 conveyed out by the first roller 21A to the sheet insertion slot 101 of the printing device 100. Since the feeding device 1 is provided with the guide receiving surface 41, the print medium S can be smoothly conveyed.

In the roll R, the print medium S is rolled around a core of a cylinder. The roll holding member 70 that holds the roll R is attached to the accommodation portion 6. The roll holding member 70 includes the tube portion 81, the flange member 85, the torsion spring 44 and the like. The torsion spring 44 of the roll holding member 70 urges the tube portion 81 in a direction opposite to a rotation direction in a state in which the flange member 85 is engaged with the receiving portion 5. The rotation direction is a direction in which the tube portion 81 rotates when the print medium S is fed from the roll R. In feeding device 1, a force can be applied to the print medium S in the direction opposite to the rotation direction in which the tube portion 81 rotates when the print medium S is fed.

The second pulley 23B includes the knob portion 29A that rolls up the protective sheet S2 to eliminate the looseness of the protective sheet S2 with respect to the roll-up roll 29. In the feeding device 1, since the knob portion 29 is provided, the looseness of the protective sheet S2 can be easily adjusted.

In the bearing portion 52, the position of the upper support roller 11 is switched between the guide position where the upper support roller 11 guides the printing target sheet S1 along the first conveyance path P1 and the non-guide position where the upper support roller 11 is away from the guide position. In the feeding device 1, since the position of the upper support roller 11 can be switched between the guide position and the non-guide position, the user can easily set the print medium S.

The cutting mechanism 7 cuts the printed print medium S discharged from the printing device 100 mounted on the mounting portion 8. In the feeding device 1, the printed print medium S can be cut by the cutting mechanism 7.

The mounting portion 8 includes the preventing portion 61 to prevent the printing device 100 mounted on the mounting portion 8 from moving in the direction opposite to the conveyance direction of the print medium S. In the feeding device 1, a position of the printing device 100 can be prevented from moving in the direction opposite to the conveyance direction by the preventing portion 61.

The longitudinal length of the first roller 21A is larger than the width of the print medium S. In the feeding device 1, the print medium S can be conveyed more reliably.

<Modification>

The feeding device 1 according to the above embodiment can be modified in various ways. In the above embodiment, the protective sheet S2 is removed from the print medium S in a state in which the printing target sheet S1, the protective sheet S2 and the ink sheet S3 are superposed in turn, and the printing target sheet S1 and the ink sheet S3 are superposed and fed to the printing device 100, but the present disclosure is not limited thereto. The feeding device 1 may feed the printing target sheet S1 to the printing device 100 from the print medium S in the state in which the printing target sheet S1 and the protective sheet S2 are superposed. In this case, when the protective sheet S2 is rolled up by the roll-up roll 29 in a process of being fed to the printing device 100, the feeding device 1 can feed only sheets necessary for printing performed by the printing device 100, which are included in the print medium S in which a plurality of sheets are superposed.

Although the first roller 21A and the second roller 21B are rollers, one of the first roller 21A and the second roller 21B may be a guide member that has a guide surface having a flat surface or a curved surface instead of the roller. For example, the first roller 21A may be the guide surface, and the second roller 21B may be the roller. Even in such a case, the guide mechanism 21 can guide the printing target sheet S1 and the ink sheet S3. In this case, the transmission mechanism 23 may be provided on a side of the second roller 21B and transmit a driving force to the roll-up roll 29. The diameters of the first roller 21A and the second roller 21B are the same, but are not limited thereto, and may be changed as appropriate. In this case, the gear ratio of the first gear 25A to the second gear 25B is not 1 to 1, and the circumferential speeds may be constant. The first gear 25A and the second gear 25B are respectively provided on the right side of the first roller 21A and the second roller 21B, but may be provided on the left side. In this case, the transmission mechanism 23 may be provided on the left side.

Arrangement positions of the upper support roller 11, the lower support roller 13, the common roller 15, the merging roller 17 and the like are not limited to the above embodiment, and may be changed as appropriate. The upper support roller 11, the lower support roller 13, the common roller 15 and the merging roller 17 are rollers, but at least one of these may be a roller. For example, the upper support roller 11, the lower support roller 13, the common roller 15 and the merging roller 17 each may be formed of a guide surface.

The guide receiving surface 41 is inclined at the angle substantially the same as that of the insertion surface 115 of the sheet insertion slot 101, but may be changed as appropriate. Although the knob portion 29A is operated by the user, the looseness of the protective sheet S2 may be eliminated by applying a mechanism of the roll holding member 70. The preventing portion 61 is not limited to a configuration described above, and may be any configuration that can prevent the printing device 100 mounted on the mounting portion 8 from moving in the direction opposite to the conveyance direction of the print medium S.

<Others>

In the above embodiment, the printing target sheet S1 is an example of a "first sheet" according to the present disclosure. The protective sheet S2 is an example of a "second sheet" according to the present disclosure. The ink sheet S3 is an example of a "third sheet" according to the present disclosure. The upper-lower direction is an example of an "orthogonal direction" according to the present disclosure. The front is an example of the "conveyance direction" according to the present disclosure. The left-right direction is an example of a "longitudinal direction" according to the present disclosure. The roll-up roll 29 is an example of a "roll-up member" according to the present disclosure. The transmission mechanism 23 is an example of a "transmission mechanism" according to the present disclosure. The torsion spring 44 is an example of an "urging member" according to the present disclosure. The flange member 85 is an example of an "engagement portion" according to the present disclosure. The roll holding member 70 is an example of a "holding member" according to the present disclosure. The cutting mechanism 7 is an example of a "cutting unit" according to the present disclosure. The upper support roller 11 is an example of a "first guide member" according to the present disclosure. The lower support roller 13 is an example of a "second guide member" according to the present disclosure. The common roller 15 is an example of a "third guide member" according to the present disclosure. The merging roller 17 is an example of a "fourth guide member" according to the present disclosure. The bearing portion 52 is an example of a "position switching member" according to the present disclosure. The tube portion 81 is an example of a "shaft member" according to the present disclosure.

What is claimed is:

1. A print medium feeding device configured to feed a print medium including a first sheet, a second sheet, and a third sheet to a printing device, the print medium being in a state in which the first sheet, the second sheet, and the third sheet are superposed, the print medium feeding device comprising:

a housing;

a mounting portion provided in the housing and configured to detachably mount the printing device;

an accommodation portion provided in the housing and configured to accommodate the print medium;

a guide mechanism disposed between the mounting portion and the accommodation portion and configured to sandwich the first sheet and the third sheet, the guide mechanism including a first roller configured to be driven to rotate by movement of the first sheet and the third sheet that is caused by a printing operation of the printing device;

a roll-up member disposed between the first roller of the guide mechanism and the accommodation portion and configured to roll up the second sheet;

a transmission mechanism configured to transmit a rotational force of the first roller to the roll-up member;

a first guide member provided in a first conveyance path, the first conveyance path extending from the accommodation portion to the first roller and being configured to allow the first sheet to be conveyed along the first conveyance path such that the first sheet moves on a first side in an orthogonal direction orthogonal to a longitudinal direction of the roll-up member; and a second guide member provided in a second conveyance path and a third conveyance path, the second conveyance path extending from the accommodation portion to the roll-up member and being configured to allow the second sheet to be conveyed along the second conveyance path, the third conveyance path extending from the accommodation portion to the first roller and being configured to allow the third sheet to be conveyed along the third conveyance path such that the third sheet moves on a second side opposite to the first side in the orthogonal direction with respect to the roll-up member.

2. The print medium feeding device according to claim 1, wherein a length of the first conveyance path and a length of the third conveyance path are the same.

3. The print medium feeding device according to claim 1, further comprising:

a third guide member disposed at a position away from the second guide member in the orthogonal direction, the third guide member being provided in the second conveyance path and the third conveyance path between the accommodation portion and the second guide member, wherein the second conveyance path and the third conveyance path include a path extending from the accommodation portion to the second guide member, the path being bent in the orthogonal direction by the third guide member.

4. The print medium feeding device according to claim 3, further comprising:

a fourth guide member provided at a position where the first conveyance path and the third conveyance path merge, wherein at least one of the first guide member, the second guide member, the third guide member, and the fourth guide member is a roller.

5. The print medium feeding device according to claim 1, further comprising:

a fourth guide member provided at a position where the first conveyance path and the third conveyance path merge.

6. The print medium feeding device according to claim 1, wherein the transmission mechanism includes:

a first pulley integrally rotatable with the first roller;

a second pulley having an outer diameter larger than an outer diameter of the first pulley and integrally rotatable with the roll-up member; and a belt hung on the first pulley and the second pulley, and wherein the first pulley is configured to transmit a driving force to the second pulley by a frictional force with the belt, wherein a slip amount of the first pulley with respect to the belt increases as a roll-up amount of the second sheet rolled up by the roll-up member increases, and wherein the roll-up member is configured to uniformly roll the second sheet as the slip amount increases.

7. The print medium feeding device according to claim 6, wherein the second pulley includes a knob portion configured to roll up the second sheet to eliminate looseness of the second sheet with respect to the roll-up member.

8. The print medium feeding device according to claim 1, wherein the guide mechanism includes a second roller facing the first roller, wherein the first roller is rotatably supported by the housing, wherein the second roller is rotatably supported by a switching mechanism configured to switch a position of the second roller between a sandwiching position where the second roller sandwiches the print medium with the first roller and a retracted position where the second roller is away from the first roller, wherein the first roller includes a first gear at an end portion on one side in a longitudinal direction, wherein the second roller includes a second gear at an end portion on the one side in the longitudinal direction, and wherein, when the second roller is located at the sandwiching position, the first gear of the first roller and the second gear of the second roller mesh with each other, whereby the first roller and the second roller rotate at equal circumferential speeds.

9. The print medium feeding device according to claim 1, further comprising:

a guide receiving surface configured to guide at least the first sheet conveyed out by the first roller to a sheet insertion slot of the printing device.

10. The print medium feeding device according to claim 1, wherein the print medium is a roll rolled around a core of a cylinder, wherein a holding member configured to hold the roll is attached to the accommodation portion, wherein the holding member includes:

a shaft member configured to be engaged with the core of the cylinder;

an engagement portion rotatably supported by the shaft member and engaged with a receiving portion provided in the housing in a disengageable manner; and an urging member configured to urge the shaft member in a direction opposite to a rotation direction in a state in which the engagement portion is engaged with the receiving portion, the rotation direction being a direction in which the shaft member rotates when the print medium is fed from the roll.

11. The print medium feeding device according to claim 1, further comprising:

a position switching member configured to switch a position of the first guide member between a guide position where the first guide member guides the first sheet along the first conveyance path and a non-guide position where the first guide member is away from the guide position.

12. The print medium feeding device according to claim 1, further comprising:

a cutting unit configured to cut the printed print medium discharged from the printing device mounted on the mounting portion.

13. The print medium feeding device according to claim 1, wherein the mounting portion includes a preventing portion configured to prevent the printing device mounted on the mounting portion from moving in a direction opposite to a conveyance direction of the print medium.

14. The print medium feeding device according to claim 1, wherein a longitudinal length of the first roller is configured to be larger than a width of the print medium.

* * * * *